US011033065B2

(12) United States Patent
Gotti

(10) Patent No.: US 11,033,065 B2
(45) Date of Patent: Jun. 15, 2021

(54) SELECTIVE VENTILATION HELMET FOR CYCLING USE

(71) Applicant: KASK S.p.A., Chiuduno (IT)

(72) Inventor: Angelo Gotti, Nembro (IT)

(73) Assignee: KASK S.P.A., Chiuduno (IT)

( * ) Notice: Subject to any disclaimer, the term of this patent is extended or adjusted under 35 U.S.C. 154(b) by 0 days.

(21) Appl. No.: 14/895,825

(22) PCT Filed: Jun. 12, 2014

(86) PCT No.: PCT/IB2014/062160
§ 371 (c)(1),
(2) Date: Dec. 3, 2015

(87) PCT Pub. No.: WO2014/199329
PCT Pub. Date: Dec. 18, 2014

(65) Prior Publication Data

US 2016/0106176 A1 Apr. 21, 2016

(30) Foreign Application Priority Data

Jun. 13, 2013 (IT) ..... MI2013A0978

(51) Int. Cl.
*A42B 3/28* (2006.01)
*A42B 3/06* (2006.01)
*A42B 3/04* (2006.01)

(52) U.S. Cl.
CPC ..... *A42B 3/283* (2013.01); *A42B 3/0493* (2013.01); *A42B 3/066* (2013.01)

(58) Field of Classification Search
CPC ..... A42B 3/28; A42B 3/281; A42B 3/283; A42B 3/066; A42B 3/0493
(Continued)

(56) References Cited

U.S. PATENT DOCUMENTS 4,028,739 A * 6/1977 Bell ..... A42B 3/228 2/411
4,115,874 A * 9/1978 Hasegawa ..... A42B 3/281 2/171.3
(Continued)

FOREIGN PATENT DOCUMENTS

DE 2344821 A1 * 10/1974 ..... A42B 3/28
DE 4009036 A1 9/1991
(Continued)

OTHER PUBLICATIONS

English machine translation of "DE 9316359 U1" via espacenet.com.*
(Continued)

*Primary Examiner* — Jameson D Collier
(74) *Attorney, Agent, or Firm* — Lucas & Mercanti, LLP

(57) ABSTRACT

The present invention concerns a selective ventilation helmet of the type having a cap structure provided with a plurality of splits which make ventilation channels passing from the inside to the outside of the helmet, A selector is also provided, which is arranged at the splits and moveable with respect to the cap structure between a closing position of the ventilation channels and a position for at least partly opening the ventilation channels, wherein the selector is moveable on a guide integrated in the said cap at the splits.

11 Claims, 7 Drawing Sheets

(58) Field of Classification Search
USPC ..... 2/425, 410, 171.3, 171.4, 171.7, DIG. 1
See application file for complete search history.

(56) References Cited

U.S. PATENT DOCUMENTS

| | | | | | |
|---|---|---|---|---|---|
| 4,434,514 | A * | 3/1984 | Sundahl | A42B 3/281 | 2/171.3 |
| 4,555,816 | A * | 12/1985 | Broersma | A42B 3/12 | 2/171.3 |
| 4,612,675 | A * | 9/1986 | Broersma | A42B 3/12 | 2/171.3 |
| 4,731,885 | A * | 3/1988 | Nava | A42B 3/283 | 2/171.3 |
| 4,995,117 | A * | 2/1991 | Mirage | A42B 3/0493 | 2/410 |
| 5,996,128 | A * | 12/1999 | Yanagihara | A42B 3/281 | 2/422 |
| 6,263,513 | B1 * | 7/2001 | Murakami | A42B 3/0493 | 2/171.3 |
| 6,405,382 | B2 * | 6/2002 | Shida | A42B 3/283 | 2/171.3 |
| 6,823,531 | B1 * | 11/2004 | Chen | A42B 3/283 | 2/171.3 |
| 7,413,506 | B2 * | 8/2008 | Arai | A42B 3/283 | 2/171.3 |
| 7,735,158 | B2 * | 6/2010 | Tsurumi | A42B 3/283 | 2/410 |
| 8,256,032 | B2 * | 9/2012 | Muskovitz | A42B 3/283 | 2/171.3 |
| 2002/0124298 | A1 * | 9/2002 | Muskovitz | A42B 3/283 | 2/410 |
| 2004/0064873 | A1 * | 4/2004 | Muskovitz | A42B 3/12 | 2/410 |
| 2004/0158914 | A1 * | 8/2004 | Tanaka | A42B 3/283 | 2/410 |
| 2004/0250339 | A1 * | 12/2004 | Musal | A42B 3/283 | 2/410 |
| 2007/0136932 | A1 | 6/2007 | Muskovitz et al. | | |
| 2008/0134415 | A1 * | 6/2008 | Pierce | A42B 3/283 | 2/410 |
| 2008/0222782 | A1 * | 9/2008 | Stokes | A42B 3/003 | 2/422 |
| 2010/0037372 | A1 * | 2/2010 | Tsuzuki | A42B 3/281 | 2/424 |
| 2011/0083255 | A1 * | 4/2011 | Krauter | A42B 3/283 | 2/410 |
| 2012/0132754 | A1 * | 5/2012 | Pina Lopez | B64C 1/06 | 244/131 |
| 2012/0180199 | A1 * | 7/2012 | Chilson | A42B 3/32 | 2/411 |
| 2016/0150845 | A1 * | 6/2016 | Leedom | A42B 3/283 | 2/414 |

FOREIGN PATENT DOCUMENTS

| | | | | |
|---|---|---|---|---|
| DE | 9316359 | U1 * | 1/1994 | A42B 3/08 |
| DE | 10303887 | B3 * | 9/2004 | A42B 3/283 |
| DE | 202011002353 | U1 * | 3/2011 | A42B 3/283 |
| EP | 2818067 | A1 * | 12/2014 | A42B 3/10 |
| JP | 2005068582 | A | 3/2005 | |
| WO | 2007041656 | A1 | 4/2007 | |

OTHER PUBLICATIONS

International Search Report based on International Application No. PCT/IB2014/062160 dated Dec. 4, 2014. (2 pages).

* cited by examiner

SELECTIVE VENTILATION HELMET FOR CYCLING USE

CROSS-REFERENCE TO RELATED APPLICATIONS

This application is a 371 of PCT/IB2014/062160, filed Jun. 12, 2014, which claims the benefit of Italian Patent Application No. MI2013A000978, filed Jun. 13, 2013.

FIELD OF THE INVENTION

The present invention refers to a selective ventilation helmet for cycling use.

BACKGROUND OF THE INVENTION

In particular, the aforementioned terms "for cycling use" intend to differentiate helmets of the present invention from helmets used in the automotive, motorcycles or other fields than those purely concerning cycling.

In the field of cycling there are two different types of helmets today which are aimed at two different uses:

- the "vented" helmet, i.e. provided with a plurality of ventilation channels; and
- the "chrono" helmet, without ventilation channels and characterised by an aerodynamic profile.

According to the requirements, today the user wears one or the other type of helmet knowing the advantages and the drawbacks of one and of the other.

Indeed, the vented helmet offers greater comfort in summer but gives greater resistance to the forward movement and does not protect against rain.

On the contrary, chrono helmets, thanks to their profile, have less resistance to forward movement but only make it possible to ventilate the head of the user in a limited manner.

In other words, today, the user makes a preliminary decision on which type of helmet to use, conscious of the fact that during use, in the case in which he desires the worn helmet to have opposite features, he has no option apart from wearing a different helmet. Examples of vented helmets are described in Us2007136932, JP2005068582, WO2007041656, DE4009036.

However, none of these helmets offer a solution, nor do they suggest one, to the problem of making a helmet that is suitable for "chrono" activities and at the same time being able to offer the user the possibility of managing the ventilation of his head if desired.

In particular, the helmets described in Us2007136932, JP2005068582, WO2007041656, DE4009036 are not suitable for "chrono" activities since the selector that opens and closes the openings is not arranged flushed with the openings themselves and therefore creates a considerable aerodynamic resistance.

SUMMARY OF THE INVENTION

Starting from such a prior art, the purpose of the present invention is that of making a selective ventilation helmet for cycling use that is different from those known, being particularly efficient and capable of selectively having classic vented helmet or chrono helmet characteristics.

According to the general inventive principle of the present application, such a purpose is achieved by providing a cap structure that is provided with a plurality of splits that make through channels for ventilation and a selector arranged at said splits and moveable between one position in which the ventilation channels are closed and at least one position for at least partly opening said ventilation channels.

The selector is arranged outside the helmet and when it closes the openings it is perfectly flushed with the rest of the structure to make an aerodynamic chrono helmet.

In particular, the selector is moveable on guide means that are integrated in the cap structure at the splits. The guide means are co-moulded inside the helmet itself.

In such a way, when the selector is in the closed position, the helmet has the same aerodynamic characteristics as chrono helmets known on the market today; when the selector is in the open position the helmet has the same characteristics as vented helmets known on the market today.

Passing from one configuration to the other can be actuated thanks to a simple manual operation of the user.

Further characteristics of the invention are highlighted by the dependent claims.

BRIEF DESCRIPTION OF THE DRAWINGS

The characteristics and the advantages of a selective ventilation helmet for cycling use according to the present invention shall become clearer from the following description, given as an example and not for limiting purposes, with reference to the attached schematic drawings, in which.

DETAILED DESCRIPTION OF THE INVENTION

Figure 1:
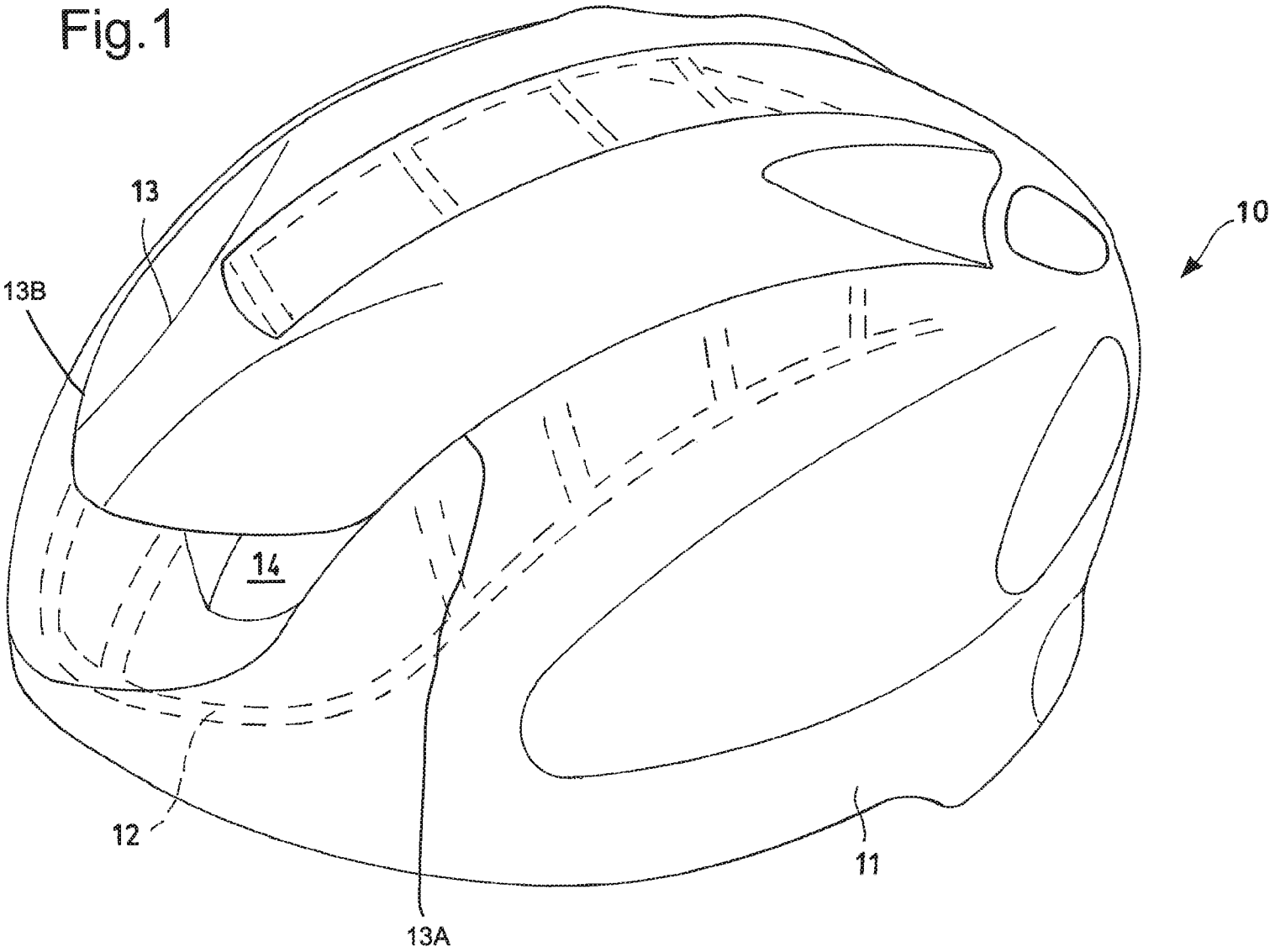
FIG. 1 shows one embodiment of a helmet according to the present invention.
Figure 2:
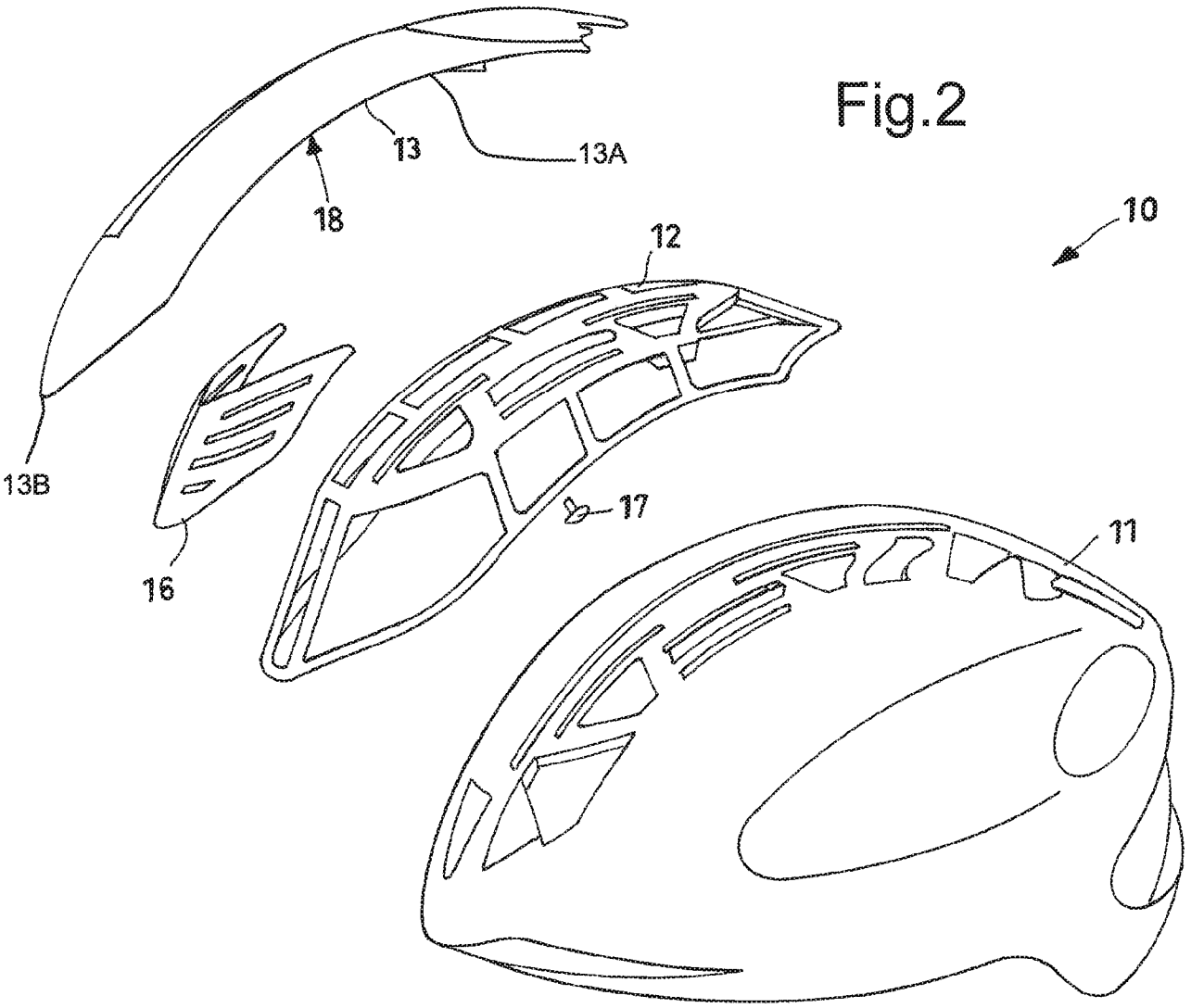
FIG. 2 shows an exploded view of the helmet of FIG. 1.
Figure 3:
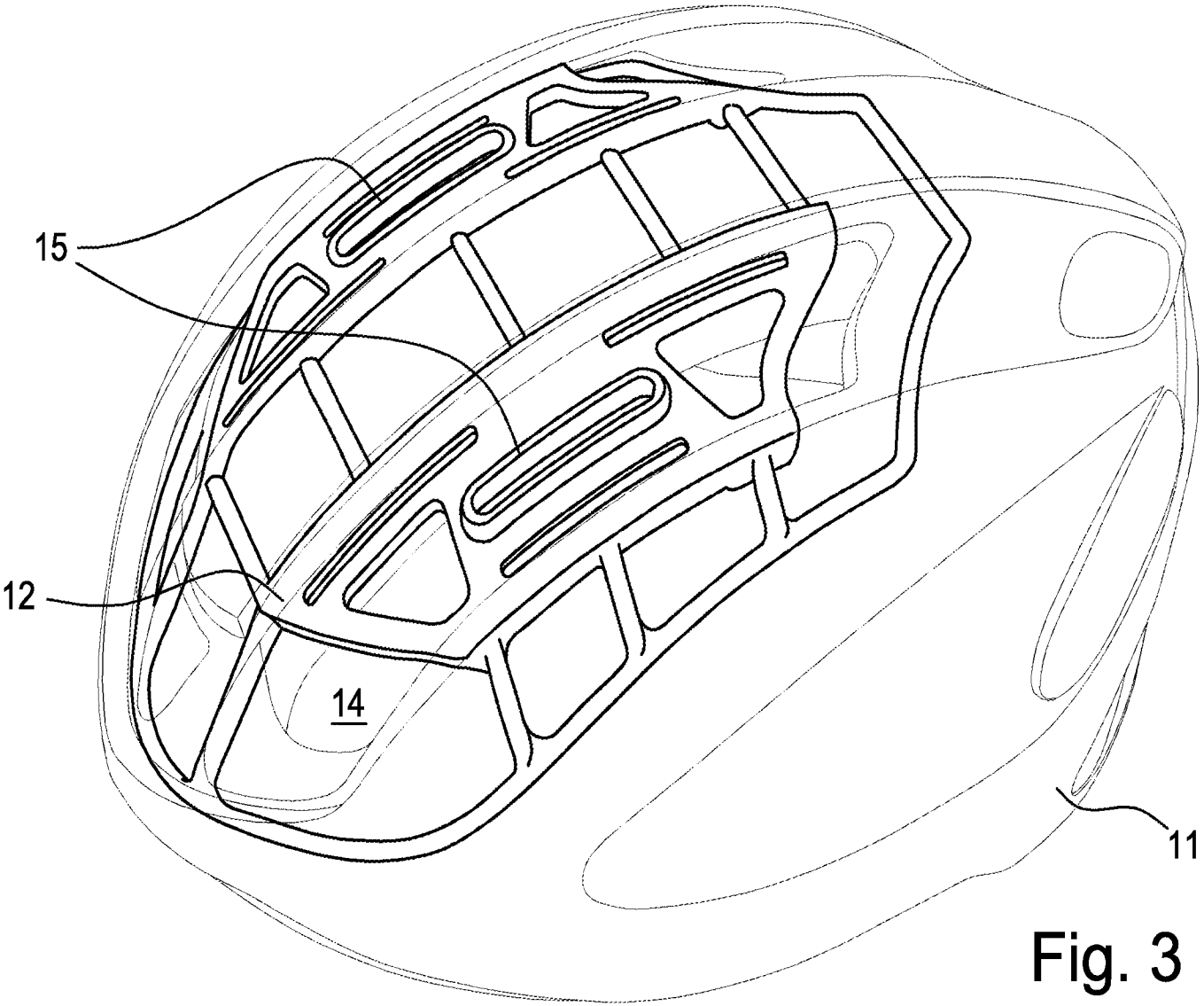
FIG. 3 shows some elements of the helmet of FIG. 1.
Figure 4:
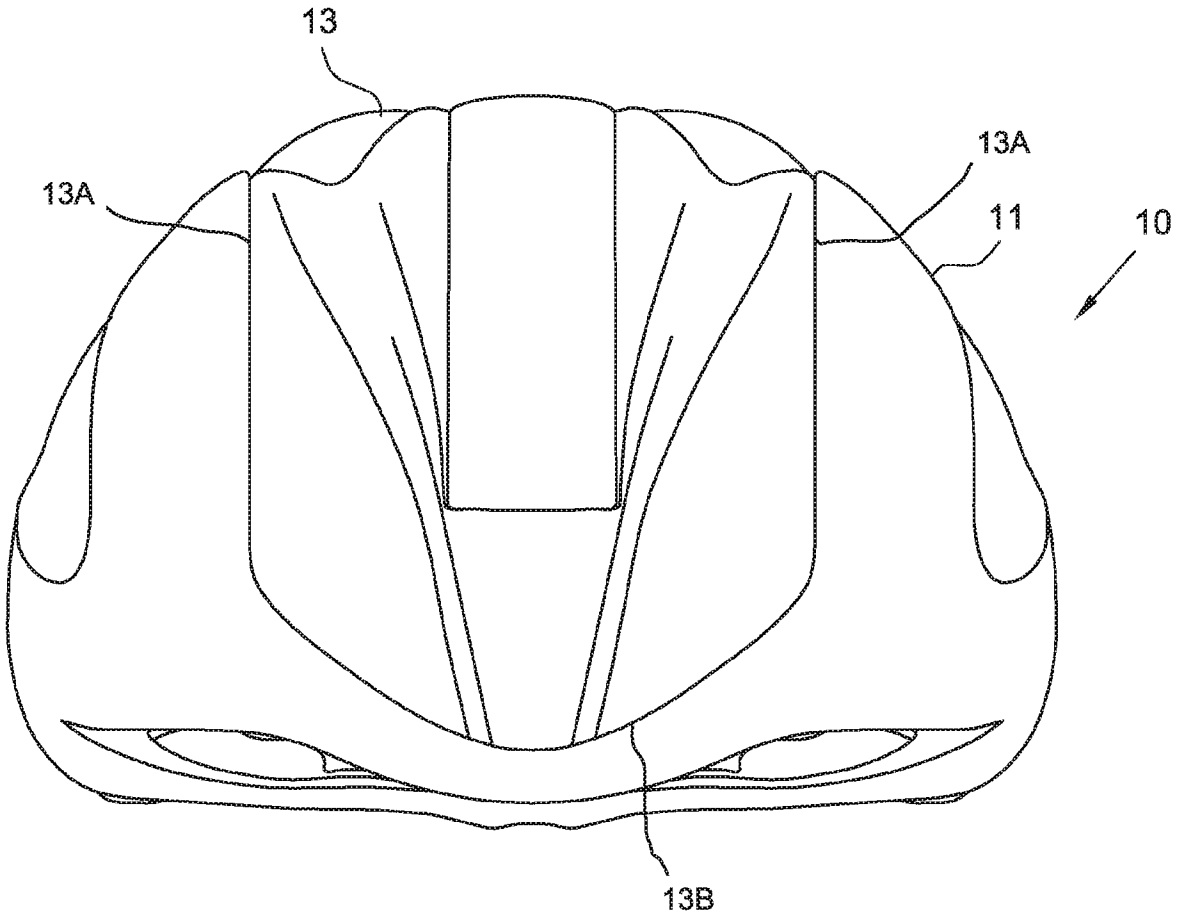
FIGS. 4, 5 and 6 show different uses of the helmet of FIG. 1.
Figure 5:
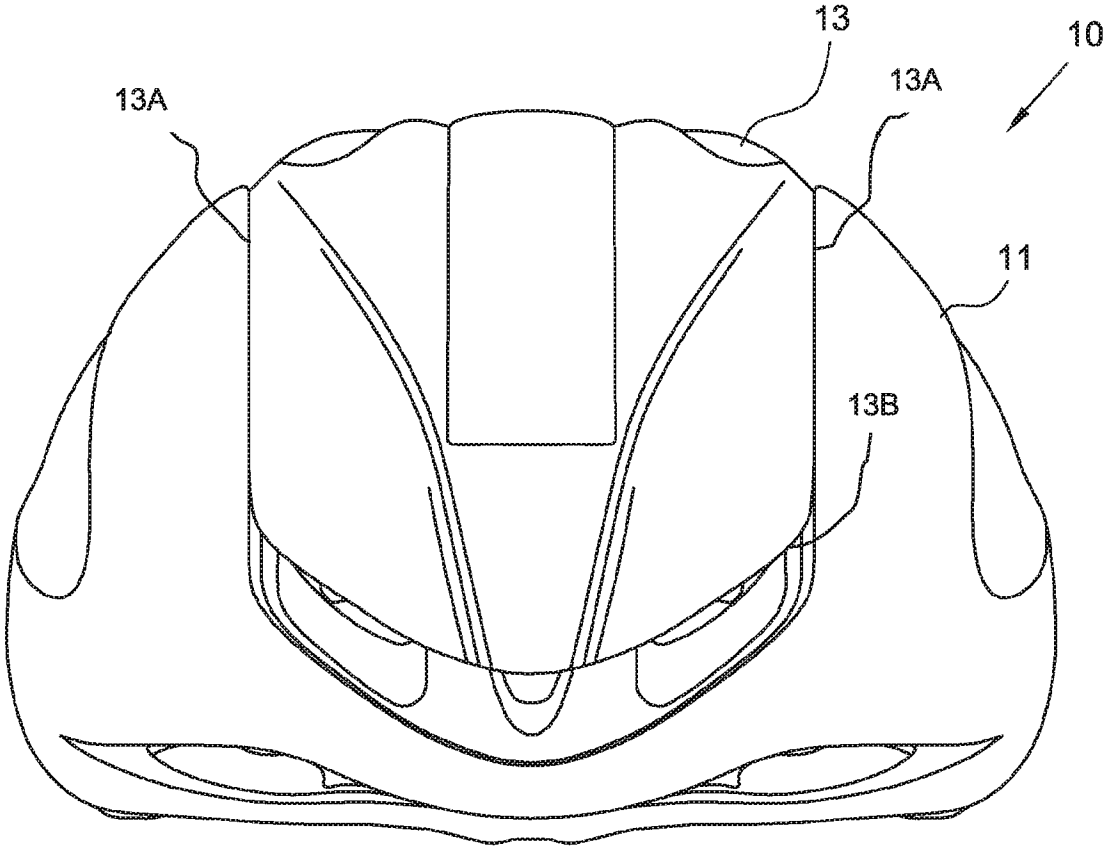
Figure 6:
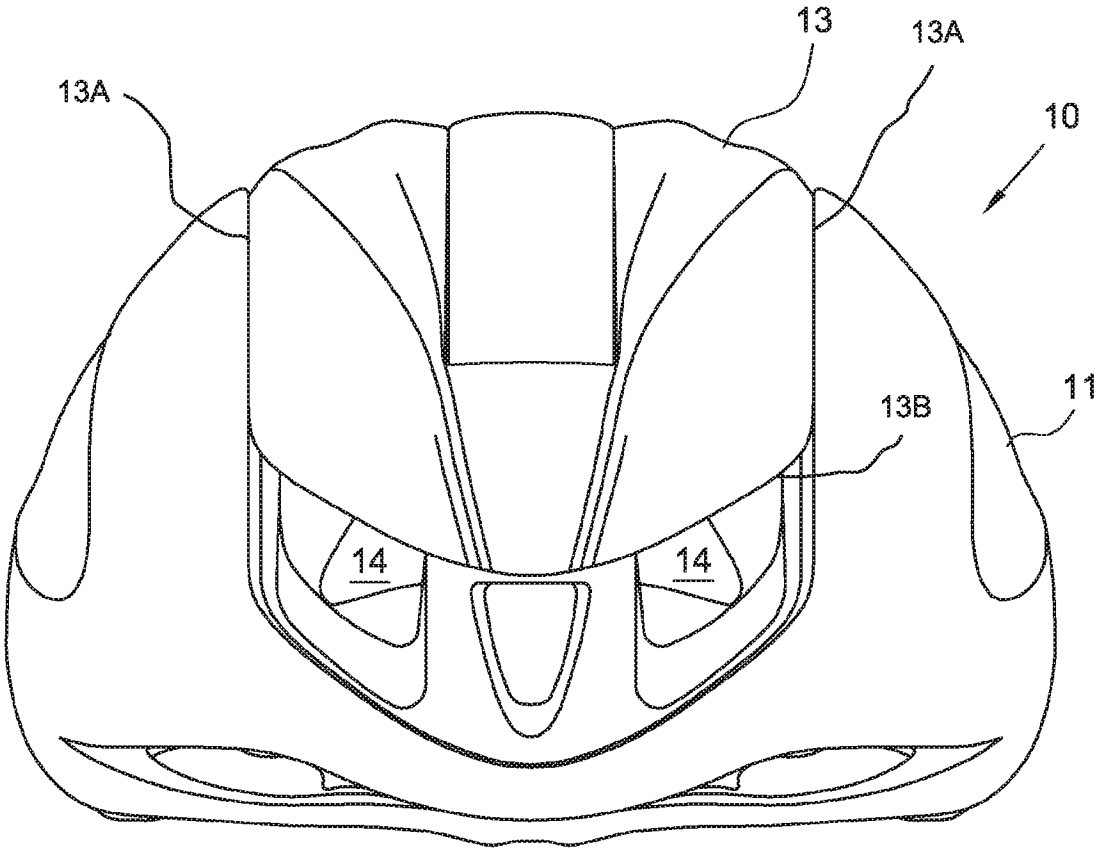
Figure 7:
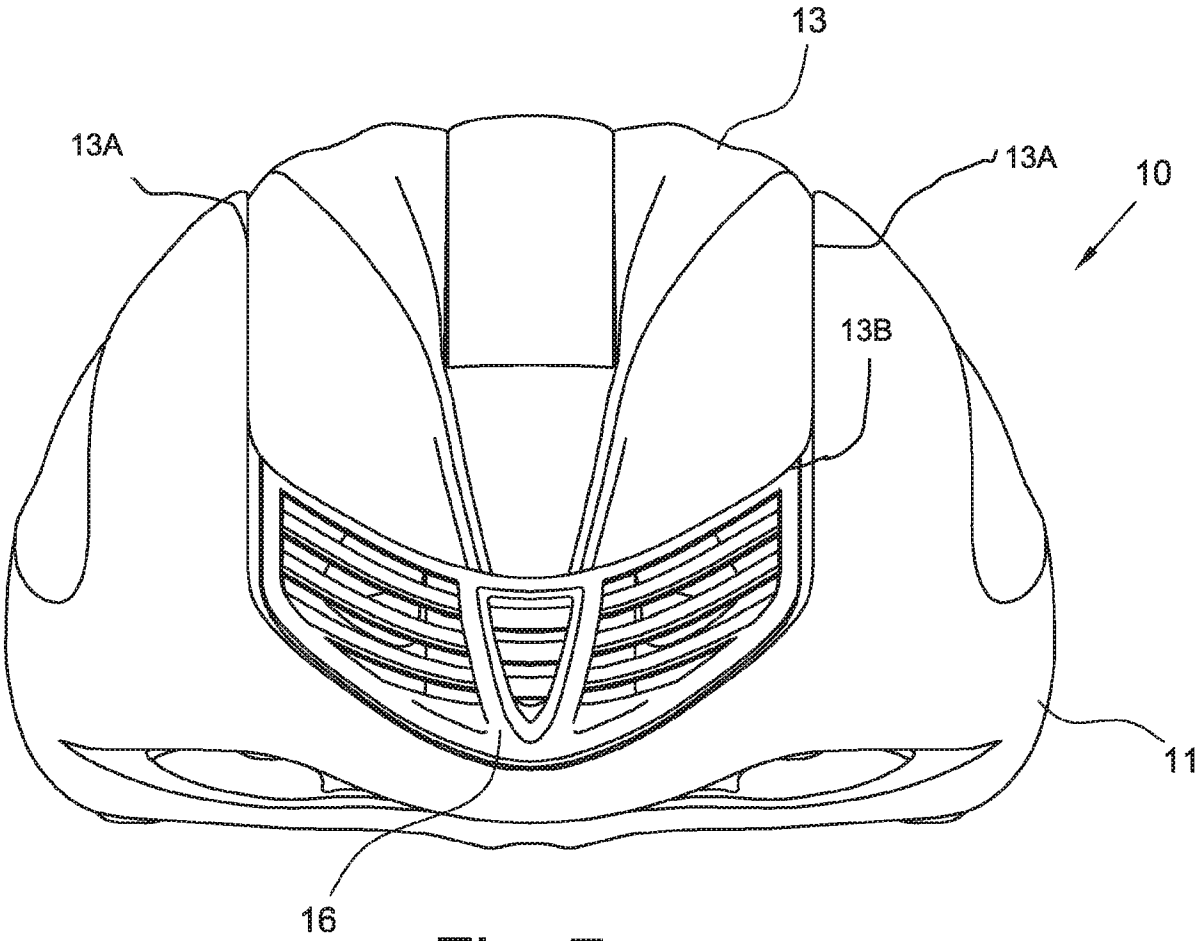
FIG. 7 shows a second embodiment of a helmet according to the present invention.

With reference to the figures, reference numeral 10 shows a selective ventilation helmet for cycling use according to the present invention.

Such a helmet is intended for cycling use and is of the type comprising:

a cap structure 11, which is shaped in an aerodynamic manner like chrono helmets in use today, and is provided with a plurality of splits 14 that make ventilation channels passing from the inside to the outside of the helmet 10; and a selector 13 positioned along the middle portion of cap structure 11 and arranged at the splits 14 so as to be mobile with respect to the length of cap structure 11 between one position in which the ventilation channels are closed and at least one position for at least partly opening them. As shown in the figures, the exterior surface of selector 13 also provides the exterior surface of helmet 10 along a middle portion of cap structure 11 and is contiguous with the external surface of cap structure 11 along both sides (13A) and front edge (13B) of selector 13.

In particular, according to the invention, the selector 13 is moveable on guide means 12 that are integrated in the cap structure 11 at the splits 14. As shown in the figures, selector 13 has a length and width. Guide means 12 extends along and transverses the length and width of selector 13.

Entering now into the constructive details, the guide means 12 is directly co-moulded in the cap structure 11 and comprises a frame that is partly embedded in the cap 11 and partly accessible at the openings 14. As shown in the figures, selector 13 has a length and a width and is superimposed onto the guide frame. Also shown in the figures, the guide frame of guide means 12 is also a one-piece structure and includes a plurality of trusses (not labelled) extending along and traversing the full length and the full width of selector 13.

Preferably, the guide means 12 comprise a slotted hole 15 for receiving a pin 18 that is arranged inside the selector 13.

A holding element 17 provides for maintaining the pin in the slotted hole 15 and for the possibility of movement of the selector 13.

In addition to the holding system 17, or screw, that connects the selector to the frame it is possible to also provide for teeth hooking, said teeth being obtained on the selector and connecting to a corresponding track. The two hooking systems, holding element or screw and teeth, can be used separately from one another but also simultaneously.

According to the example shown in the figures, the selector 13 is U-shaped so as to simultaneously open or close the channels 14 of both sides of the helmet 10. As shown in the figures, channels 14 start from the front of helmet 10. The position of the selector 13 (when the selector is closed) is at the front of cap structure 11. Also shown in the figures, selector 13 has a front edge 13B extending transverse to the length of the cap structure 11 where the front edge 13B abuts the exterior surface at the front (not labelled) of cap structure 11. Selector 13 can be of any other shape that is functional for the purpose of the present invention. In order to be able to be aerodynamic, the selector 13 is housed in a seat of the cap structure 11 so as to be flushed with the same when selector 13 is in the closed position and front edge 13B abuts the front exterior surface of cap structure 11.

In such a way, in the closed position, the helmet 10 has an external profile that is perfectly aerodynamic without a step discontinuity in passing between the cap and the closed selector 13 where front edge 13B of the selector 13 abuts the exterior surface at the front of the cap structure. Irrespective of selector 13 being opened or closed, the exterior surface of selector 13 remains completely exposed in all of the positions.

When the helmet is used in the vented manner, the helmet can be provided for there to be the presence of a front grid 16 positioned between selector 13 and guide frame 12 for partially superimposing the front of the channels 14.

Preferably, the grid can be selectively removable or fixed; in such a last case, the selector 13 is moveable above the grid 16 itself.

It has thus been seen that a helmet with selective ventilation for cycling use according to the present invention achieves the purposes previously highlighted. Very briefly, it is indeed possible to identify the following advantages:

- the user has the possibility of obtaining a classic cycling helmet and thus vented and with a simple gesture he can transform it into a closed and aerodynamic chrono type helmet that makes it possible to increase its performance;
- a single product can be used in winter (closing it) and in summer (opening it), rain or shine, again with a simple switching gesture; when the helmet is closed it does not allow water to filter inside;
- in addition to being able to use the product open or closed, there is also the intermediate step of adjusting the amount of air flow with stepped movements of the selector;
- possibility of adding an anti-insect grid that is made of plastic or of other material like fabric or metal at front vented holes.

The selective ventilation helmet for cycling use of the present invention thus conceived is subject to numerous modifications and variants, all covered by the same inventive concept; moreover, all the details can be replaced by technically equivalent elements. In practice, the materials used, as well as their dimensions, can be of any type according to the technical requirements.

The invention claimed is:

1. Helmet for cycling use, said helmet comprising:

a cap structure having a front, a back, and a length extending between said front and said back, said cap structure further having an exterior surface and an interior space and being provided with a plurality of ventilation channels passing from said exterior surface at said front of said cap structure to said interior space of said cap structure, a selector having a length and a width, said selector being provided with a front edge extending transverse to said length, which is arranged at said ventilation channels and moveable with respect to said cap structure between a closing position of said ventilation channels whereby said front edge of said selector abuts said exterior surface at said front of said cap structure and at least one position for at least partly opening said ventilation channels whereby said front edge of said selector is spaced from said front of said cap structure, wherein said selector is moveable on and superimposed onto a guide frame integrated in said cap structure at said ventilation channels, said guide frame being positioned between said selector and said cap structure, said guide frame extending and traversing said length and said width of said selector and includes a plurality of trusses extending and traversing said length and said width of said selector, wherein said selector is housed in a seat on said exterior surface of said cap structure, so that in said closing position of said ventilation channels, said selector is flush with said cap structure without a step discontinuity between said cap structure and said selector where said front edge of said selector abuts said exterior surface at said front of said cap structure, and wherein said selector has an exterior surface being completely exposed in all of the positions, said exterior surface of said selector providing an exterior surface of said helmet along a middle portion of said cap structure and being contiguous with said exterior surface of said cap structure.

2. Helmet according to claim 1, wherein said guide frame is co-moulded in said cap structure.

3. Helmet according to claim 1, wherein said guide frame is partly embedded in said cap structure and partly accessible at said ventilation channels.

4. Helmet according to claim 3, wherein said guide frame has a slotted hole for receiving a pin, said slotted hole being arranged inside said selector such that said slotted hole is configured to have said pin disposed therein.

5. Helmet according to claim 4, wherein said helmet further comprises a holding element for maintaining said pin in said slotted hole.

6. Helmet according to claim 1, wherein said selector is adapted to simultaneously open or close said ventilation channels of both sides of said helmet.

7. Helmet according to claim 1, wherein said helmet further comprises a front grid partly superimposing said ventilation channels, said front grid being positioned between said selector and said guide frame.

8. Helmet according to claim 7, wherein said selector is moveable above said front grid.

9. Helmet according to claim 7, wherein said front grid is removable from said cap structure.

10. The Helmet according to claim 1, wherein said guide frame and said plurality of trusses extend and traverse a full length and a full width of said selector.

11. The Helmet according to claim 1, wherein said guide frame is a one-piece structure.

* * * * *